US007275854B2

(12) United States Patent
Dorleijn et al.

(10) Patent No.: US 7,275,854 B2
(45) Date of Patent: Oct. 2, 2007

(54) LAMP AND LAMPHOLDER WITH PERIPHERAL LOCKING MEANS

(75) Inventors: Jan Willem Frederik Dorleijn, Roosendaal (NL); Nicolas Gerardus Antonius Peeters, Eindhoven (NL); Markus Pieper, Arnsberg (DE); Karl-Wilhelm Vogt, Ense-Höingen (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 343 days.

(21) Appl. No.: 10/508,459

(22) PCT Filed: Mar. 14, 2003

(86) PCT No.: PCT/IB03/00970

§ 371 (c)(1),
(2), (4) Date: Sep. 21, 2004

(87) PCT Pub. No.: WO03/081126

PCT Pub. Date: Oct. 2, 2003

(65) Prior Publication Data

US 2005/0174765 A1 Aug. 11, 2005

(30) Foreign Application Priority Data

Mar. 26, 2002 (EP) ..... 02076200

(51) Int. Cl.
*H01R 33/00* (2006.01)

(52) U.S. Cl. ..... 362/649; 362/217; 362/260; 313/318.06; 439/366; 439/419

(58) Field of Classification Search ..... 362/217, 362/260, 414, 655, 649; 313/318.01, 318.06, 313/318.07, 316; 439/168, 220, 360, 366, 439/414, 419
See application file for complete search history.

(56) References Cited

U.S. PATENT DOCUMENTS 5,585,688 A * 12/1996 DeKleine ..... 313/318.01
5,746,615 A 5/1998 Ichikawa et al.
6,779,911 B2 * 8/2004 Chang ..... 362/430

FOREIGN PATENT DOCUMENTS

EP 0935082 A1 11/1999

* cited by examiner

*Primary Examiner*—John Anthony Ward

(57) ABSTRACT

The invention relates to a lamp comprising a lamp bulb (2) and a lamp base (3), which lamp base (3) comprises a projection (4) located in a substantially central position of the lamp base (3) and extending in a direction away from the lamp bulb (2), at least one lock-engaging portion (6), and a substantially flat base surface (5) opposed to the lamp bulb (2) and surrounding the projection (4), characterized in that the at least one lock-engaging portion (6) is located on the edge of the base surface (5) surrounding the projection (4) remote from the central projection. The invention also relates to a lampholder (10) for cooperation with the lamp (1) according the invention, the lampholder (10) comprising an aperture (12) in a substantially central position of the lampholder (10), at least one counter lock-engaging portion (15), and a substantially flat holder surface (11) surrounding the aperture, characterized in that the at least one counter lock-engaging portion (15) is located on the edge of the holder surface (11) surrounding the aperture (12) remote from the central aperture (12).

19 Claims, 3 Drawing Sheets

LAMP AND LAMPHOLDER WITH PERIPHERAL LOCKING MEANS

The invention relates to a lamp comprising a lamp bulb and a lamp base, which lamp base comprises a projection located in a substantially central position of the lamp base and extending in a direction away from the lamp bulb, at least one lock-engaging portion, and a substantially flat base surface opposed to the lamp bulb and surrounding the projection. The invention also relates to a lampholder for cooperation with the lamp according the invention, the lampholder comprising an aperture in a substantially central position of the lampholder, at least one counter lock-engaging portion, and a substantially flat holder surface surrounding the aperture.

The U.S. Pat. No. 5,746,615 discloses a lighting device, especially used for discharge lighting, with a base that is disposed at one end of a bulb, and a single-ended lamp socket into which the base is to be inserted and then twisted to be rotatively engaged with the socket. The lamp has a projection and a lamp pin, both projecting from a bottom of the base. The socket has a recess into which the projection of the lamp is inserted and rotated through a predetermined angle. The lighting device is effectively used and has the advantage of easy exchange of bulbs. However, a disadvantage of the lighting device according to the cited US patent is that a bulb is not always positioned in the same way in the lamp socket, leading to a sub-optimal use of luminaries and/or a less aesthetic positioning of light sources.

It is an object of the invention to provide a lamp and a lampholder suited for simple exchange of lamps but also providing a solid and well-defined positioning of the lamp. A further object of the present invention is to delimit the height of the lamp in the situation in which the lamp and lampholder are coupled.

According the invention, a lamp comprising a lamp bulb and a lamp base of the type described in the opening paragraph is characterized in that the at least one lock-engaging portion is located on the edge of the base surface surrounding the projection remote from the central projection. In a preferred embodiment, the lamp comprises a plurality of lock-engaging portions, which lock-engaging potions are distributed over the edge of the base surface remote from the central projection. Locating the at least one lock-engaging portion on the edge of the base surface remote from the central projection brings the advantage of an increased stability of the lamp when coupled to the lampholder also provided by the present invention. The lampholder according the invention is of the type described in the opening paragraph and characterized in that the at least one counter lock-engaging portion is located on the edge of the holder surface surrounding the aperture remote from the central aperture. A lock-engaging portion and a counter lock-engaging portion achieve the fixation of the lamp and lampholder through cooperation of these two elements, but also through cooperation of the projection of the lamp and the aperture of the lampholder and through cooperation of the base surface and the holder surface. The effect of the distance between the lock-engaging portion and the counter lock-engaging portion, and between the projection and the aperture, is an enhanced stability of the coupling compared with the coupling according the prior art wherein lock-engaging portions, as far as they can be identified, are integrated with the projection/aperture. When use is made of a plurality of lock-engaging portions and a cooperating plurality of counter lock-engaging portions in the lampholder, the advantage of an increased stability will be further enhanced. The base surface and the holder surface can provide a large reference plane ensuring a good positioning of a lamp in a lampholder (or the luminaire that contains the lampholder). The lock-engaging portion on the lamp may comprise a hook-shaped element to cooperate with, for example, a slit in the lampholder. The advantage of locating the relatively fragile hook-shaped element on the lamp is that with renewal of a lamp also the hook-shaped element is renewed. The construction of a simple hook-shaped element may be realized from synthetic-resin material, making metal springs for retention forces superfluous. The lamp according the invention further has the advantage that it can be constructed with only a limited height; the function of the projection of the lamp is to guide the lamp and not to lock or couple it to the environment. Due to the fact that the projection only has one objective, it can have only a limited height, making the whole lamp comparatively compact (in height) compared with the prior art.

The central projection has a cross-section that is preferably parallel to the base surface surrounding the projection, the latter being substantially circular to cooperate with a preferred lampholder having a central aperture with a cross-section parallel to the holder surface surrounding the substantially circular aperture. The circular shape in cross-section has the advantage of enabling guidance of the lamp base, dependent of the dimensions of the projection and aperture, while the projection is being inserted into the aperture, and of enabling (continuous) guidance during rotation of the lamp in the lampholder. The improved guidance of the lamp during its coupling or releasing makes the process of coupling/releasing better controlled, thus preventing problems with improper handling of the lamp and lampholder.

In another preferred embodiment, the lamp base is provided with key means for identification of the lamp. The key means may comprise at least one aperture in the central projection extending in a direction opposed to the lamp bulb. For cooperation with such a lamp, the invention also provides a preferred embodiment of the lampholder that is provided with counter key means for controlled cooperation with a key-identified lamp. Such counter key means may comprise at least one projection in the central aperture. Key and counter key means can prevent improper use of a combination of lamp and lampholder. Thus, for example, it may be prevented that a high-voltage lamp is used in a lampholder only designed for low-voltage lamps or vice versa. An aperture in the projection and a projection in the aperture have the advantage that such a construction can be made difficult to damage. Another advantage is that the projection/aperture can prepare the relative location of key and counter key means.

In yet another preferred embodiment of the lamp, the lamp base is provided with contact members arranged opposite to the lamp bulb and projecting from the base surface that is located opposite to the lamp bulb and that surrounds the projection. The contact members, for example contact pins, may be placed in a straight line, optionally located on opposite sides of the central projection. For cooperation with the contact members, the invention also provides a preferred embodiment of the lampholder that is provided with counter contact members below the holder surface, preferably in a touch-proof position, surrounding the aperture. The counter contact members may also be placed in a straight line, for instance on opposite sites of the central aperture. The contact members and counter contact members are to cooperate especially to power the lamp. Locating the contact members and counter contact members in line makes the production of lamp and lampholder simpler and thus cheaper; the contact organs and counter contact members are better accessible to connect them to (lead) wires in the lamp and lampholder.

Non-limitative embodiments of the invention will now be further explained with reference to the accompanying drawing, in which.

Figure 2A:
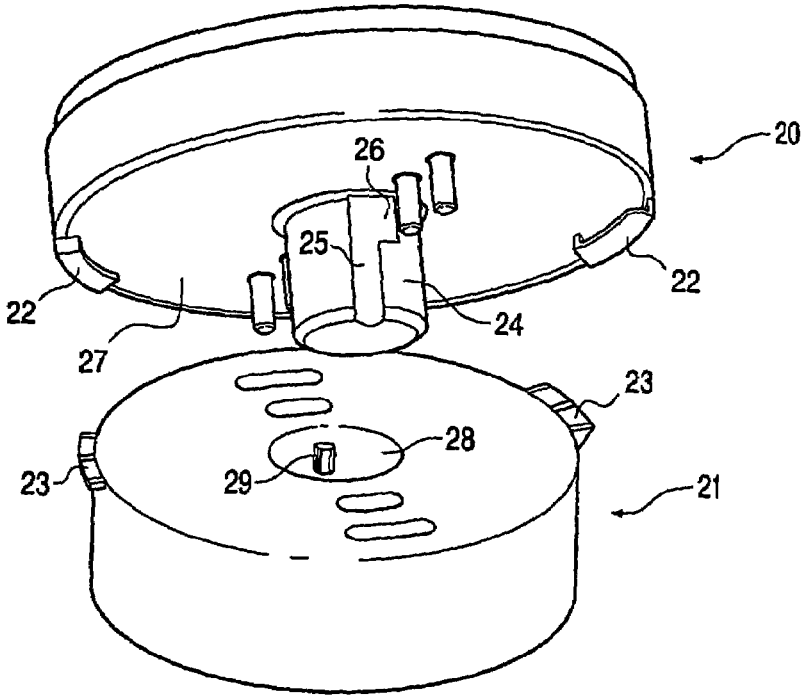
Figure 2B:
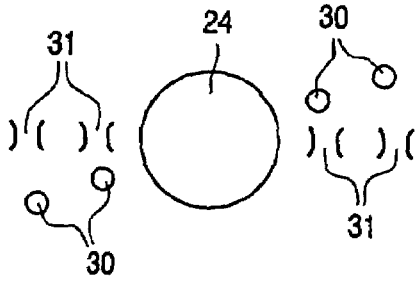
Figure 2C:
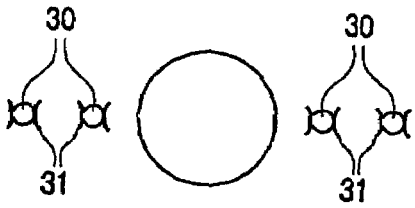
Figure 3:
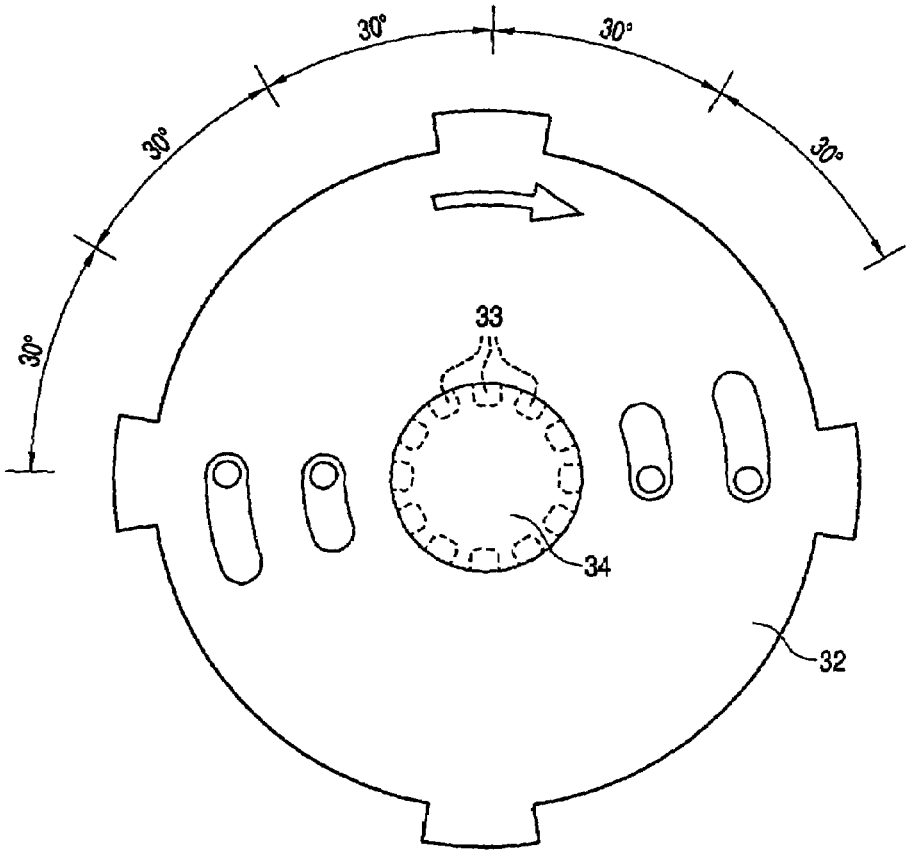

FIG. 2A is a perspective view of a combination of lamp base and lampholder according to the invention, FIG. 2B is a partial plan view of contact members and counter contact members in an insertion or removal position, FIG. 2C is a partial plan view of the contact members and the counter contact members of FIG. 2B in a contact position, and FIG. 3 is a plan view of a lampholder with an indication of optional counter key positions.

Figures 1A, 1B:
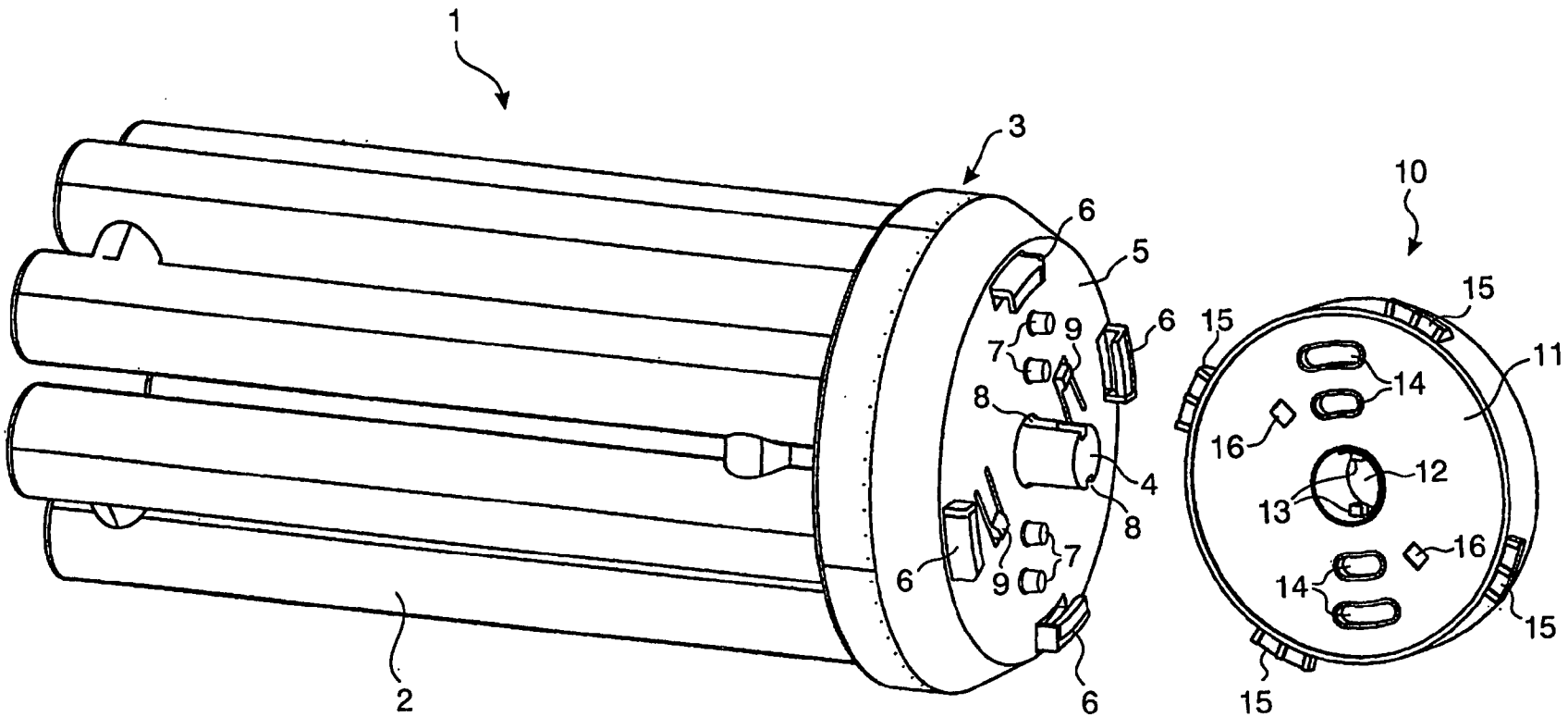
FIG. 1A is a perspective view of a lamp according to the invention.
FIG. 1B is a perspective view of a lampholder according to the invention.

FIG. 1A shows a discharge lamp 1 with a tubular discharge vessel 2 containing, not illustrated, electrodes for creating a discharge path. The lamp 1 also has a lamp base 3, holding the discharge vessel 2 and the electrodes, with a central projection 4 that points away from the discharge vessel 2. The projection 4 is surrounded by a base surface 5 with peripheral coupling hooks 6 (also referred to as lock-engaging portions 6). The base 3 also holds contact pins 7 (also referred to as contact members 7) in a parallel orientation to the projection 4 and also pointing away from the discharge vessel 2. Key slits 8 in the projection 4 will be explained with reference to FIG. 2. The lamp base 3 also has catches 9 that are resiliently connected to the base surface 5. Although the above description only refers to discharge lamps, the lamp according the invention may also be an incandescent lamp.

For operation of the lamp 1, the contact pins 7 have to be brought in contact with a power supply. Another demand for successful operation of the lamp 1 is that its position is controlled. A lampholder 10 as shown in FIG. 1B can provide both of these functions. The lampholder 10 has a holder surface 11 with a central aperture 12 that can hold the projection 4 of the lamp 1. In the aperture 12 are key notches 13 which will be explained with reference to FIG. 2. The holder surface 11 of the lampholder 10 also has slots 14 for cooperation with the contact pins 7 of the lamp 1 that enable the pins 7 to be moved after they have been inserted into the openings 14 of counter contact members. On the periphery of the holder surface 11 are protrusions 15 to be held by the coupling hooks 6 of the lamp 1. After insertion of the projection 4 into the aperture 12 and of the pins 7 into the openings 14, the lamp 1 can be rotated relative to the lampholder 10 about the axis of the projection 4. This will make the coupling hooks 6 cooperate with the protrusions 15, thus coupling the lamp 1 and the lampholder 10. For an even better indication of the optimal relative positions of the lamp 1 and the lampholder 10, the catches 9 on the lamp 1, that are forced back to positions at the level of the base surface 5 during the insertion of the lamp 1 into the lampholders, can take their original positions when they reach holes 16 provided for this purpose in the holder surface 11. The catches 9 are located in the base 3 as the resilient connection can wear in time. The base 3, however, will be changed at the end of life of the lamp 1, and thus the catches, being a part of the lamp 1, will also be changed. The cooperation of the catches 9 and the holes 16 will result in a stop of the coupling of lamp 1 and lampholder 10, providing a "feeling" that the lamp is correctly mounted and offers a resistance against loosening, for instance due to vibrations. The resilient catches 9 may be made of plastic without the need for metal springs. An additional stop function can be provided by side walls of the coupling hooks 6 in cooperation with the protrusions of the holder surface 11.

FIG. 2A shows a combination of lamp base 20 and lampholder 21 according to the invention. The lampholder 21 in this Figure has only two coupling hooks 22, and the lampholder 21 has only two protrusions 23. This, however, does not change the way of coupling of the lamp base 20 and the lampholder 21 relative to the coupling of the lamp 1 and the lampholder 10 as shown in FIGS. 1A and 1B. Protrusion 24 of the lamp base 20 has a key slit 25 with a chamber 26 on the side of the slit 25 that is close to the base surface 27. The protrusion 24 can only be inserted into the aperture 28 of the lampholder 21 when a key notch 29 located in the aperture 28 fits in the key slit 25. After a substantial insertion of the protrusion 24 into the aperture 28, the chamber 26 will reach the notch 29, thus enabling the lamp base 20 to be rotated relative to the lampholder 21. The coupling can only be successful if the positions of the slit 25, chamber 26, and notch 29 are mutually attuned. If the slit 25, chamber 26, and notch 29 are not mutually aligned, the coupling will be prevented, thus providing a security against undesired couplings of lamp bases 20 and lampholders 21.

FIG. 2B is a partial plan view of contact pins 30 and receiving members 31 in a position in which the protrusion 24 has been inserted into the aperture 28 (see FIG. 2A) before the contact pins 30 have been turned into their contact position or after the contact pins 30 have been turned out of their contact position. FIG. 2C shows the contact pins 30 and the receiving members 31 in a contact position. The contact pins 30 and receiving members 31 now cooperate, so the pins 30 could be in a contact position with a power source (not illustrated).

Finally, FIG. 3 is a plan view of a lampholder 32 according to the invention with an indication of various optional positions of notches 33 (indicated by broken lines) located in a central aperture 34. Dependent on the position (positions) of the notch (notches) in the aperture 34, the lampholder 32 can cooperate with a lamp that is provided with key slits (see FIGS. 1A and 2A) in corresponding positions.

The invention claimed is:

1. A lamp comprising a lamp bulb and a lamp base, which lamp base comprises a projection located in a substantially central position of the lamp base and extending in a direction away from the lamp bulb, at least one lock-engaging portion, and a substantially flat base surface opposed to the lamp bulb and surrounding the projection, characterized in that the at least one lock-engaging portion is located on the edge of the base surface surrounding the projection remote from the central projection.

2. A lamp as claimed in claim 1, characterized in that the lamp comprises a plurality of lock-engaging portions, which lock-engaging portions are distributed over the edge of the base surface remote from the central projection.

3. A lamp as claimed in claim 1, characterized in that the central projection has a substantially circular cross-section taken parallel to the base surface surrounding the projection.

4. A lamp as claimed in claim 1, characterized in that the lamp base is provided with key means for identification of the lamp.

5. A lamp as claimed in claim 4, characterized in that the key means comprise at least one aperture in the central projection extending in a direction opposite to the lamp bulb.

6. A lamp as claimed in claim 1, characterized in that the lamp base is provided with contact members opposite to the lamp bulb and projecting from the base surface that is located opposite to the lamp bulb and that surrounds the projection.

7. A lamp as claimed in claim 6, characterized in that the contact members are placed in a straight line.

8. A lamp as claimed in claim 6, characterized in that the contact members are located on opposite sides of the central projection.

9. A lampholder for cooperation with a lamp, the lampholder comprising an aperture in a substantially central position of the lampholder, at least one counter lock-engaging portion, and a substantially flat holder surface surrounding the aperture, characterized in that the at least one counter lock-engaging portion is located on the edge of the holder surface surrounding the aperture remote from the central aperture.

10. A lampholder as claimed in claim 9, characterized in that the lampholder comprises a plurality of counter lock-engaging portions, which counter lock-engaging portions are distributed over the edge of the holder surface remote from the central aperture.

11. A lampholder as claimed in claim 9, characterized in that the central aperture has a substantially circular cross-section taken parallel to the holder surface surrounding the aperture.

12. A lampholder as claimed in claim 9, characterized in that the lampholder is provided with counter key means for controlled cooperation with a key-identified lamp.

13. A lampholder as claimed in claim 12, characterized in that the counter key means comprise at least one projection in the central aperture.

14. A lampholder as claimed in claim 9, characterized in that the lampholder is provided with counter contact members below the holder surface surrounding the aperture.

15. A lampholder as claimed in claim 14, characterized in that the counter contact members are placed in a straight line.

16. A lampholder as claimed in claim 14, characterized in that the counter contact members are located on opposite sides of the central aperture.

17. An assembly of a lamp comprising a lamp bulb and a lamp base, which lamp base comprises a projection located in a substantially central position of the lamp base and extending in a direction away from the lamp bulb, at least one lock-engaging portion, and a substantially flat base surface opposed to the lamp bulb and surrounding the projection, the at least one lock-engaging portion beomg located on the edge of the base surface surrounding the projection remote from the central projection; and a lampholder for cooperation with a lamp, the lampholder comprising an aperture in a substantially central position of the lampholder, at least one counter lock-engaging portion, and a substantially flat holder surface surrounding the aperture, the at least one counter lock-engaging portion being located on the edge of the holder surface surrounding the aperture remote from the central apertureas wherein the projection of the lamp is smaller than the aperture of the lampholder for cooperation of lamp and lampholder, and the at least one lock-engaging portion is located on the edge of the base surface for cooperation with at least one counter lock-engaging portion located on the edge of the holder surface.

18. A lamp comprising a lamp bulb; and a lamp base comprising a substantially flat base surface opposed to the lamp bulb;

a central projection, located in a substantially central position of the lamp base and extending from the base surface in a direction away from the lamp bulb;

at least one lock-engaging portion located on the edge of the base surface remote from the central projection, key means, comprising at least one aperture in the central projection, the key means serving to identify the lamp;

a plurality of contact members, projecting from the base surface opposite the lamp bulb, and distributed so that at least two are opposite one another about the central projection.

19. A lamp holder comprising a substantially flat holder surface for receiving a base surface of a lamp;

an aperture in a substantially central position of the holder surface;

at least one counter lock-engaging mechanism located on the edge of the holder surface remote from the aperture for receiving at least one corresponding lock-engaging mechanism on the lamp;

counter key means for receiving a key means on the lamp and comprising at least one projection in the aperture, the key means serving to identify the lamp; and a plurality of counter contact members below the holder surface, for receiving a plurality of corresponding contact members on the lamp, and distributed so that at least two are opposite one another about the central projection.

* * * * *